US007694645B2

(12) United States Patent
Yasuda et al.

(10) Patent No.: US 7,694,645 B2
(45) Date of Patent: Apr. 13, 2010

(54) ROTARY ATOMIZATION HEAD PAINTING DEVICE

(75) Inventors: Shinichi Yasuda, Fujieda (JP); Yukinori Miyamoto, Yamato (JP)

(73) Assignee: ABB K.K., Tokyo (JP)

( * ) Notice: Subject to any disclaimer, the term of this patent is extended or adjusted under 35 U.S.C. 154(b) by 1095 days.

(21) Appl. No.: 10/568,413

(22) PCT Filed: Feb. 9, 2005

(86) PCT No.: PCT/JP2005/002359

§ 371 (c)(1),
(2), (4) Date: Feb. 14, 2006

(87) PCT Pub. No.: WO2005/079996

PCT Pub. Date: Sep. 1, 2005

(65) Prior Publication Data

US 2007/0157881 A1 Jul. 12, 2007

(30) Foreign Application Priority Data

Feb. 23, 2004 (JP) ..... 2004-046652

(51) Int. Cl.
*B05C 5/02* (2006.01)

(52) U.S. Cl. ..... 118/323; 118/624; 118/629; 239/224; 239/703; 239/704; 239/708

(58) Field of Classification Search ..... 118/323, 118/624, 629, 696, 708; 239/224, 700, 703, 239/704, 708; 427/421.1, 458
See application file for complete search history.

(56) References Cited

U.S. PATENT DOCUMENTS 4,593,360 A * 6/1986 Cocks ..... 700/123
6,849,130 B2 * 2/2005 Estelle ..... 118/682

FOREIGN PATENT DOCUMENTS

JP 11-123348 5/1999
JP 2002-192022 7/2002

* cited by examiner

*Primary Examiner*—Laura Edwards
(74) *Attorney, Agent, or Firm*—Oblon, Spivak, McClelland, Maier & Neustadt, L.L.P.

(57) ABSTRACT

An air source (11) is connected to an air motor (3) through an electropneumatic converter (12) which is connected to a rotational controller (13). Upon changing settings in a target rotational speed (N0) or paint discharge rate (Q0), in order to supply a necessary air pressure for rotationally driving the air motor (3) in a steady state with new setting conditions, the rotation controller (13) selects a steady value (is) from a rotational data selection processing table, and outputs to the electropneumatic converter (12) the newly selected steady value (is) as an input current value (i). By so doing, the rotational speed of the air motor (3) is quickly controlled toward the changed target rotational speed (N0).

5 Claims, 11 Drawing Sheets

Fig.3

17 (ROTATIONAL DATA SELECTION PROCESSING TABLE)

| | | PAINT DISCHARGE RATE[cc/min] | | | | | | |
|---|---|---|---|---|---|---|---|---|
| | | 0 | 100 | 200 | 300 | 400 | ··· | 1000 |
| TARGET ROTATIONAL SPEED[rpm] | 5000 | i00 | i01 | i02 | i03 | i04 | ··· | i0n |
| | 10000 | i10 | i11 | i12 | i13 | i14 | | i1n |
| | 20000 | i20 | i21 | i22 | i23 | i24 | | i2n |
| | 30000 | i30 | i31 | i32 | i33 | i34 | | i3n |
| | ⋮ | ⋮ | | | | | ⋱ | |
| | 100000 | im0 | im1 | im2 | im3 | im4 | | imn |

Fig.8

24 (ROTATIONAL DATA SELECTION PROCESSING TABLE)

| COEFFICIENT OF VISCOSITY $\eta 0$, SPECIFIC GRAVITY $\kappa 0$ | | | | | | | | |
|---|---|---|---|---|---|---|---|---|
| | | PAINT DISCHARGE RATE [cc/min] | | | | | | |
| | | 0 | 100 | 200 | 300 | 400 | ··· | 1000 |
| TARGET ROTATIONAL SPEED[rpm] | 5000 | i000 | i001 | i002 | i003 | i004 | ··· | i00n |
| | 10000 | i010 | i011 | i012 | i013 | i014 | | i01n |
| | 20000 | i020 | i021 | i022 | i023 | i024 | | i02n |
| | 30000 | i030 | i031 | i032 | i033 | i034 | | i03n |
| | ⋮ | ⋮ | | | | | ⋱ | |
| | 100000 | i0m0 | i0m1 | i0m2 | i0m3 | i0m4 | | i0mn |

Fig.9

25 (ROTATIONAL DATA SELECTION PROCESSING TABLE)

| COEFFICIENT OF VISCOSITY $\eta$ 1, SPECIFIC GRAVITY $\kappa$ 1 | | | | | | | | |
|---|---|---|---|---|---|---|---|---|
| | | PAINT DISCHARGE RATE[cc/min] | | | | | | |
| | | 0 | 100 | 200 | 300 | 400 | ··· | 1000 |
| TARGET ROTATIONAL SPEED[rpm] | 5000 | i100 | i101 | i102 | i103 | i104 | ··· | i10n |
| | 10000 | i110 | i111 | i112 | i113 | i114 | | i11n |
| | 20000 | i120 | i121 | i122 | i123 | i124 | | i12n |
| | 30000 | i130 | i131 | i132 | i133 | i134 | | i13n |
| | ⋮ | ⋮ | | | | | ⋱ | |
| | 100000 | i1m0 | i1m1 | i1m2 | i1m3 | i1m4 | | i1mn |

ROTARY ATOMIZATION HEAD PAINTING DEVICE

TECHNICAL FIELD

This invention relates to a rotary atomizing head type coating machine particularly suitable, for example, for use in coating bodies of automotive vehicles and the like.

BACKGROUND ART

Generally, there have been known so-called rotary atomizing head type coating machines which are constituted of an air motor which is connected to an atomizing head, a speed sensor for detection of rotational speed of the air motor, an air source for supplying driving air to the air motor, an electropneumatic converter for adjusting a supply air pressure from the air source according to an electrical quantity, and a controller for controlling an electrical quantity to be output to the electropneumatic converter on the basis of detected rotational speed and a target rotational speed (e.g., Japanese Patent Laid-Open No. 2002-192022).

In the case of the prior art rotary atomizing head type coating machines of this sort, by way of a feedback control of an air motor, an electrical quantity to be applied to an electropneumatic converter is adjusted by a controller in such a way as to minimize a difference between a detected rotational speed and a target rotational speed of an air motor. Therefore, in the case of conventional rotary atomizing head type coating machines, for example, an air motor is driven at a speed which is within a differential range of ±5% relative to a target rotational speed of approximately 3,000 rpm to 1,000 rpm thereby putting the rotary atomizing head in high speed rotation while supplying a paint to the rotary atomizing head in this condition. As a result, the supplied paint to the rotary atomizing head is atomized by rotary atomization (by centrifugal atomization) to form finely divided paint particles. Atomized paint particles are charged by a rotary atomizing head at an external electrode to urge a flight from the coating machine toward a work piece along an electrostatic field for deposition on the work piece.

In the case of the atomizing head type coating machine by the above-mentioned prior art, an air motor is employed as a drive source for the rotary atomizing head instead of an electric motor. The reasons for this are: (1) High insulating properties of compressed air of the drive source make it easier to insulate the motor as a part to be applied with a high voltage; (2) Relatively simple construction permits reductions in size and cost and inexpensive maintenance and service; and (3) No possibilities of volatile and flammable organic solvent and paint taking fire within the motor.

However, an air motor has a relatively small torque so that the rotational speed of the motor is easily fluctuated by variations in load conditions of the rotary atomizing head (the air motor), for example, when paint supply is turned on and off. On such an occasion, if the rotational speed of the atomizing head is increased, paint is divided into particles of a smaller diameter. On the contrary, if the rotational speed is lowered, paint is divided into particles of a larger diameter. In this connection, it is important to maintain paint particles in a uniform size because the paint particle size has great influences on the quality of finish touches. On the other hand, the rotational speed of the atomizing head varies as the paint supply is switched on and off, making it difficult to atomize paint into an aimed particle size because of impairing the quality of coatings.

Especially, in recent years, it is usually the case for a coating machine to switch paint supply on and off repeatedly several tens times per one car body while coating same according to shapes of its exterior surfaces. Besides, due to a demand from coating industries, there has been a trend toward high paint discharge operations using a paint with a large content of a highly viscous non-volatile component of a high specific gravity. As a consequence, the rotational speed is fluctuated to a greater degree by on-off of paint supply, and deviated from a target rotational speed for a longer time (e.g., for 7 to 10 seconds). In addition, fluctuations in rotational speed take place several tens times per one car body, each time disturbing the paint particle size which has extremely great influences on the quality of coatings.

DISCLOSURE OF THE INVENTION

In view of the above-mentioned problems with the prior art, it is an object of the present invention to provide a rotary atomizing head type coating machine which can control a rotational speed of an air motor quickly to a target rotational speed and improve a quality of paint when a change is made in settings of operating conditions or factors of coating operations, for example, when changing a paint supply rate or at the time of suspending paint supply.

(1) According to the present invention, in order to achieve the above-stated objective, there is provided a rotary atomizing head type coating machine, which includes a rotary atomizing head for spraying supplied paint, an air motor coupled with the rotary atomizing head and rotated by a supply of air, a speed sensor adapted to detect rotational speed of the air motor, an air source for supplying an air to the air motor, an electropneumatic converter adapted to adjust an air pressure supplied from the air source according to an electrical quantity, and a controller adapted to control an electrical quantity to be output to the electropneumatic converter in such a way as to diminish a differential between said rotational speed detected by the speed sensor and a given target rotational speed, for feedback control of the air pressure.

The rotary atomizing head type coating machine according to the present invention is characterized in that the controller is provided with a steady value computing means adapted to compute a necessary value of electrical quantity as a steady value against given settings in arbitrary target rotational speed and paint discharge rate for driving the air motor steadily in the vicinity of the given target rotational speed and at the paint discharge rate, when either the target rotational speed or the paint discharge rate is changed, the controller being adapted to compute a new steady value on basis of the changed target rotational speed and paint discharge rates by the use of the steady value computing means and to output to the electropneumatic converter an electrical quantity on the basis of the freshly computed steady value.

With the arrangements just described, upon changing a setting of target rotational speed or paint discharge rate, the air motor can be quickly controlled toward and steadily driven in the vicinity of a target rotational speed. Therefore, despite alterations of operating conditions, paint can be sprayed toward a work piece in a desired particle size to guarantee deposition of coatings of high quality.

(2) According to the present invention, the steady value computation means is adapted to compute a steady value of the electrical quantity on the basis of coefficient of viscosity and specific gravity of paint in addition to the target rotational speed and paint discharge rate.

In this case, even if load on the rotary atomizing head is varied depending upon coefficient of viscosity and specific gravity of paint, the air motor can be quickly controlled to drive in a steady state.

(3) According to the present invention, the controller is adapted to output to the electropneumatic converter an electrical quantity for an air pressure higher than that of the steady value when a setting of the target rotational speed is to be changed to a higher speed, for rotating the air motor at a speed higher than a newly set target rotational speed, and an electrical quantity for an air pressure lower than that of the new steady value when said target rotational speed is to be changed to a lower speed, for rotating the air motor at a speed lower than a newly set target rotational speed.

With the arrangements just described, upon increasing or decreasing the rotational speed of the air motor, an air pressure to be applied to the air motor can be increased or decreased as compared with a steady state. Accordingly, the air motor can be quickly controlled toward a target rotational speed, suppressing time lags which might otherwise occur due to alteration of settings in operating conditions, while preventing overshooting which occurs when the rotational speed is increased or decreased to an unnecessary extent beyond the target rotational speed.

(4) According to the present invention, the controller is adapted to go to feedback control on the basis of the differential in rotational speed, after the detected rotational speed has reached the target rotational speed.

In this case, upon changing a setting of the target rotational speed, the rotational speed of the air motor can be quickly controlled toward a target rotational speed by outputting to the electropneumatic converter an electrical quantity larger or smaller than a steady value, and, as soon as the target rotational speed is reached, the controller goes to feedback control based on the differential in rotational speed, holding the rotational speed of the air motor in the vicinity of the target rotational speed.

(5) According to the present invention, at the time of suspending paint supply, the controller is adapted to preset a target rotational speed at the same value as a target rotational speed to be set upon restarting paint supply.

As a result, while paint supply is suspended, the rotational speed of the air motor can be set at a speed which is required at the time of restarting paint supply, for the purpose of suppressing to a minimum fluctuation in rotational speed which would occur upon restarting paint supply for suppressing time lags which might otherwise due to alteration of setting in operating conditions.

(6) According to the present invention, the controller is adapted to increase the paint discharge rate as well as the target rotational speed at the time of coating a broad surface area of a work piece, and to decrease the paint discharge rate as well as the target rotational speed at the time of coating a narrow surface area of a work piece.

As a result, on a broad coasting surface area of a work piece, the rotational speed of the rotary atomizing head is increased to enlarge a paint spray pattern, and, on a narrow coating surface area, the rotational speed of the rotary atomizing head is decreased to diminish the paint spray pattern. At the circumstances, it is necessary to enlarge and diminish the paint spray pattern depends on broad and narrow coating surface area. Since paint discharge rate is increased and decreased in synchronism with the increase and decrease of the rotational speed, paint can be atomized into almost the same particle size constantly irrespective of enlargement or diminution of the paint spray pattern. Consequently, constant finish touch can be maintained to improve the quality of a paint spray.

BRIEF DESCRIPTION OF THE DRAWINGS

In the accompanying drawings:

FIG. 3 is a rotational data selection processing table according to the first embodiment of the invention;

FIG. 8 is a first rotational date selection processing table employed in the second embodiment;

FIG. 9 is a second rotational date selection processing table employed in the second embodiment;

BEST MODE FOR CARRYING OUT THE INVENTION

Figure 1:
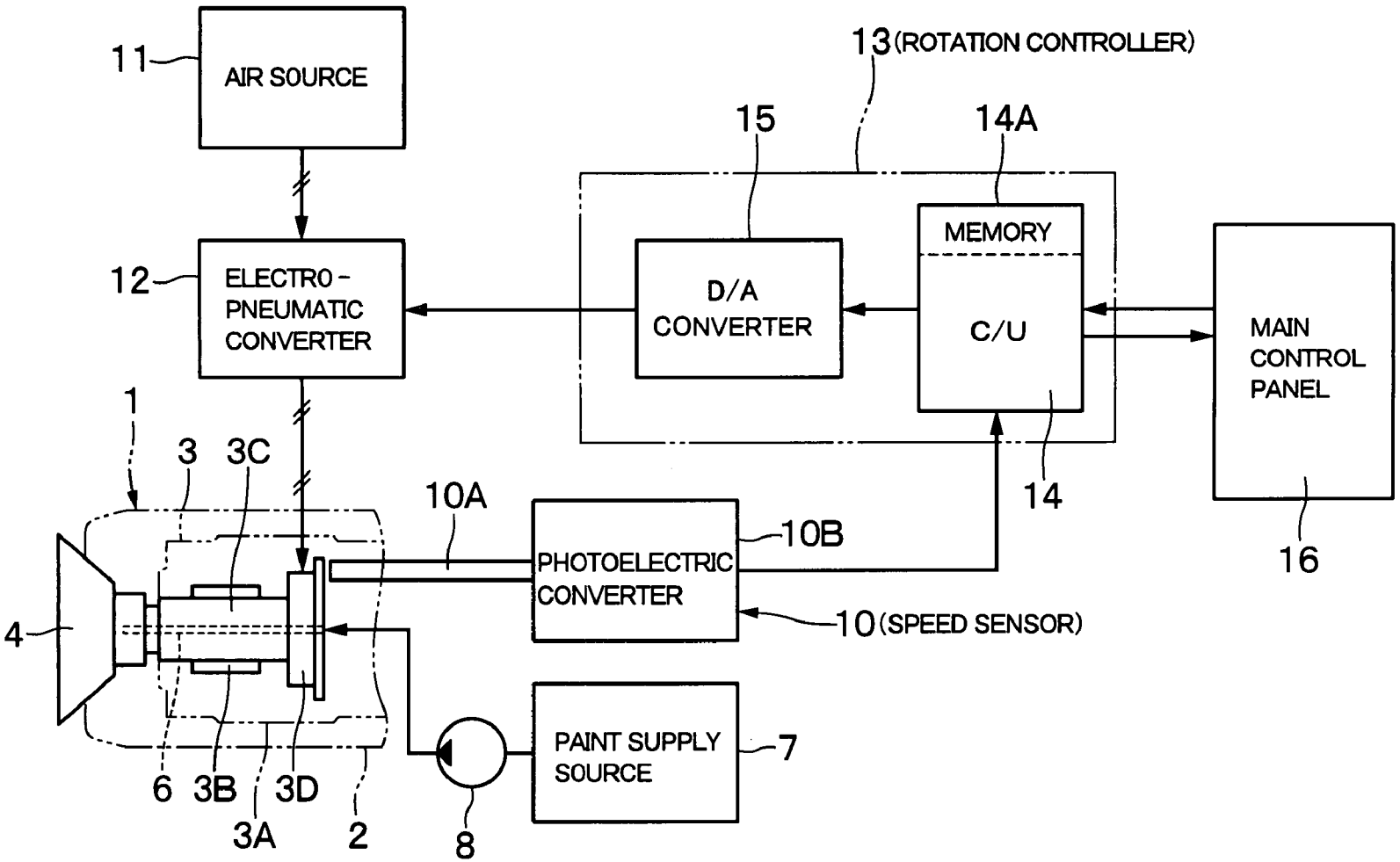
FIG. 1 is a diagrammatic illustration of a rotary atomizing head type coating machine according to a first embodiment of the invention, showing general arrangements of the machine.
Figure 2:
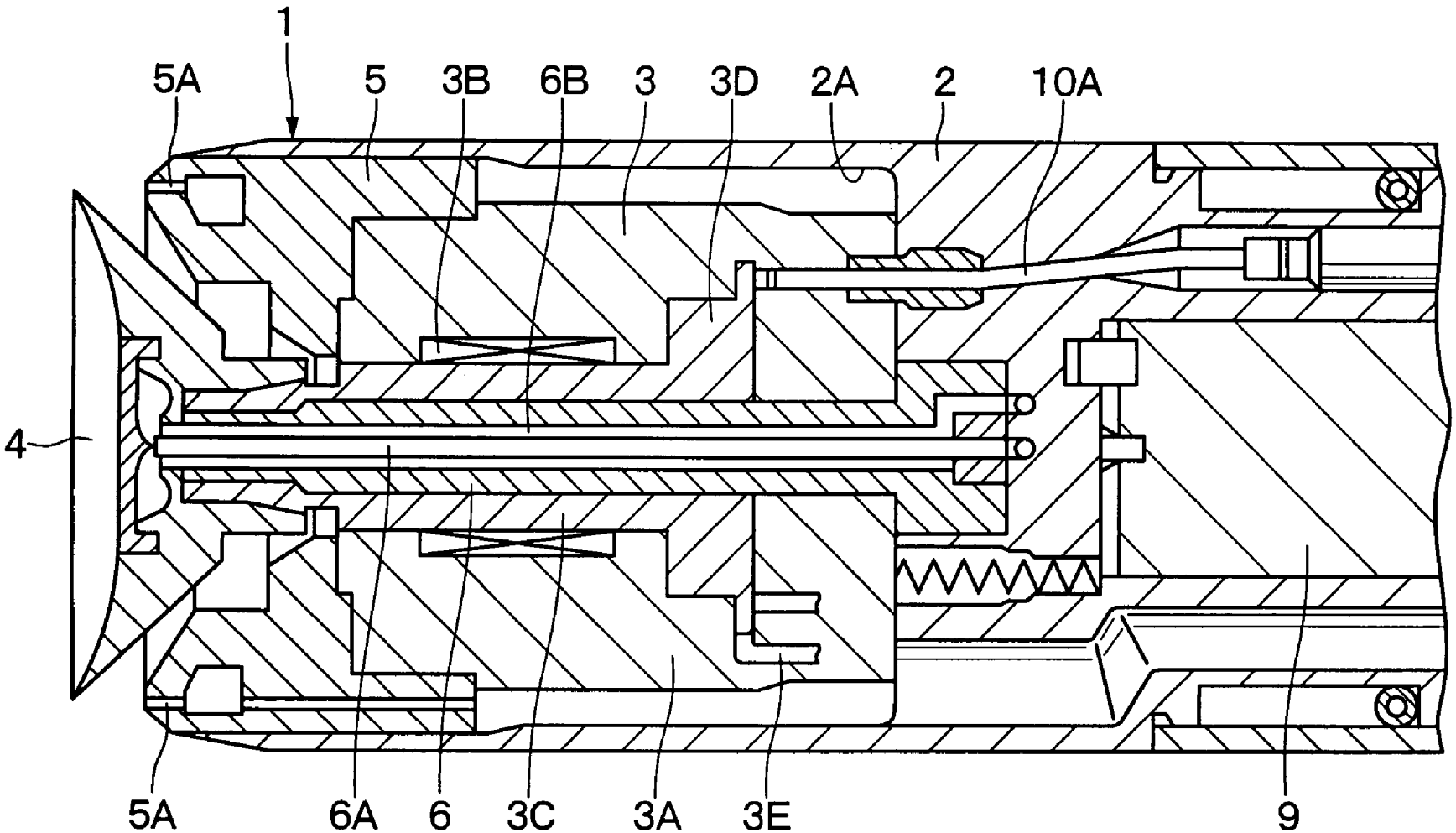
FIG. 2 is a vertical sectional view of a coater unit shown in FIG. 1.

Hereafter, with reference to the accompanying drawings, the rotary atomizing head coating machine of the present invention is described more particularly by way of its preferred embodiments.

Referring first to FIGS. 1 through 6, there is shown a first embodiment of the present invention. In these figures, indicated at 1 is a coater unit by which paint is sprayed toward a work piece (not shown) which is at the earth potential. The coater unit 1 is largely constituted by a cover 2, air motor 3 and rotary atomizing head 4 as described in greater detail hereinafter.

Indicated at 2 is a cylindrical cover which is arranged to enshroud an air motor 3 and a high voltage generator 9. The cover 2 internally defines a motor room 2A for accommodation of air motor 3.

Indicated at 3 is an air motor which is accommodated in the motor room 2A in the cover 2. The air motor 3 is constituted by a motor housing 3A, a hollow rotational shaft 3C which is rotatably supported in the motor housing 3A through a static pressure air bearing 3B, and an air turbine 3D which is fixed on a base end side of the rotational shaft 3C. By supplying air to the air turbine 3D through an air supply passage 3E, the rotational shaft 3C and the rotary atomizing head 4 are rotated at a high speed, for example, at the speed of 3,000 rpm to 100,000 rpm.

Denoted at 4 is a rotary atomizing head which is mounted on a fore end of the rotational shaft 3C of the air motor 3. This rotary atomizing head 4 is formed, for example, of a metallic material or electrically conductive synthetic resin material, and, while being put in high speed rotation by the air motor 3, supplied with paint through a feed tube 6 to spray the paint from marginal edges by centrifugal force which is described in hereinafter.

Indicated at 5 is a shaping air ring which is provided on the front end of the cover 2 in such a way as to circumvent the rotary atomizing head 4. A plural number of air outlet holes 5A is located in the shaping air ring 5 to spurt shaping air toward paint particles which are sprayed by the rotary atomizing head 4.

Indicated at 6 is a feed tube which is passed internally of the rotational shaft 3C. Fore end of the feed tube 6 is projected from fore end of the rotational shaft 3C and extended into the rotary atomizing head 4. Provided internally of the feed tube 6 are a paint passage 6A and a thinner passage 6B, which are connected to a paint supply source 7 through a gear pump 8. In this instance, the paint supply source 7 is in the form of a color changing valve device (CCV) which is arranged to discharge paint of a selected color or a wash fluid like thinner. The gear pump 8 is a fixed volume type pump which is adapted to discharge a fixed amount of paint per revolution, and can deliver paint at a desired rate (at a desired discharge rate) which is determined by its rotational speed. Thus, by the gear pump 8 and through the feed tube 6, paint or thinner is supplied to the rotary atomizing head 4 at a desired supply rate.

Indicated at 9 is a high voltage generator which is built in a base end side of the cover 2. In this case, the high voltage generator 9 is constituted by a multiple-voltage rectifier circuit (the so-called Cockcroft circuit), composed of a plural number of condensers and diodes (which are not shown in the drawings), to generate a high voltage, for example, a high voltage of from DC −30 kV to −120 kV. The high voltage generator 9 is adapted to charge paint with a high voltage directly through the air motor 3 and the rotary atomizing head 4.

Designated at 10 is a speed sensor to detect rotational speed of the air motor 3. The speed sensor 10 is constituted, for example, by a fiber optics cable 10A which is formed by the use of fiber optics of glass material or synthetic resin material, and an photoelectric converter 10B which is connected to the fiber optics cable 10A. Base end of the fiber optics cable 10A is connected to the photoelectric converter 10B, while fore end of the fiber optics cable 10A is extended forward as far as a point in the vicinity of the air turbine 3D of the air motor 3. Through the fiber optics cable 10A, a light ray is cast on the air turbine 3D by the photoelectric converter 10B, and a signal indicative of the rotational speed of the air motor 3 is produced on the basis of light reflections from the air turbine 3D.

Indicated at 11 is an air supply source for the air motor 3. From this air source 11, high pressure air is supplied toward the air turbine 3D of the air motor 3 through an electropneumatic converter 12, which will be described hereinafter.

Indicated at 12 is an electropneumatic converter which is adapted to adjust air pressure from the air source 11, according to electric current which is input as an electric quantity by a rotation controller 13, which will be described hereinafter. This electropneumatic converter 12 is connected to a rotation controller 13, which will be described after, and a current value i, for example, a current of approximately 4 mA to 20 mA is input to the electropneumatic converter 12 from the rotation controller 13. According to the input current value i, an air pressure to be supplied to the air motor 3 is determined by the electropneumatic converter 12. As an electrical quantity to be input to the electropneumatic converter 12, a voltage or resistance may be used instead of a current.

Figure 4:
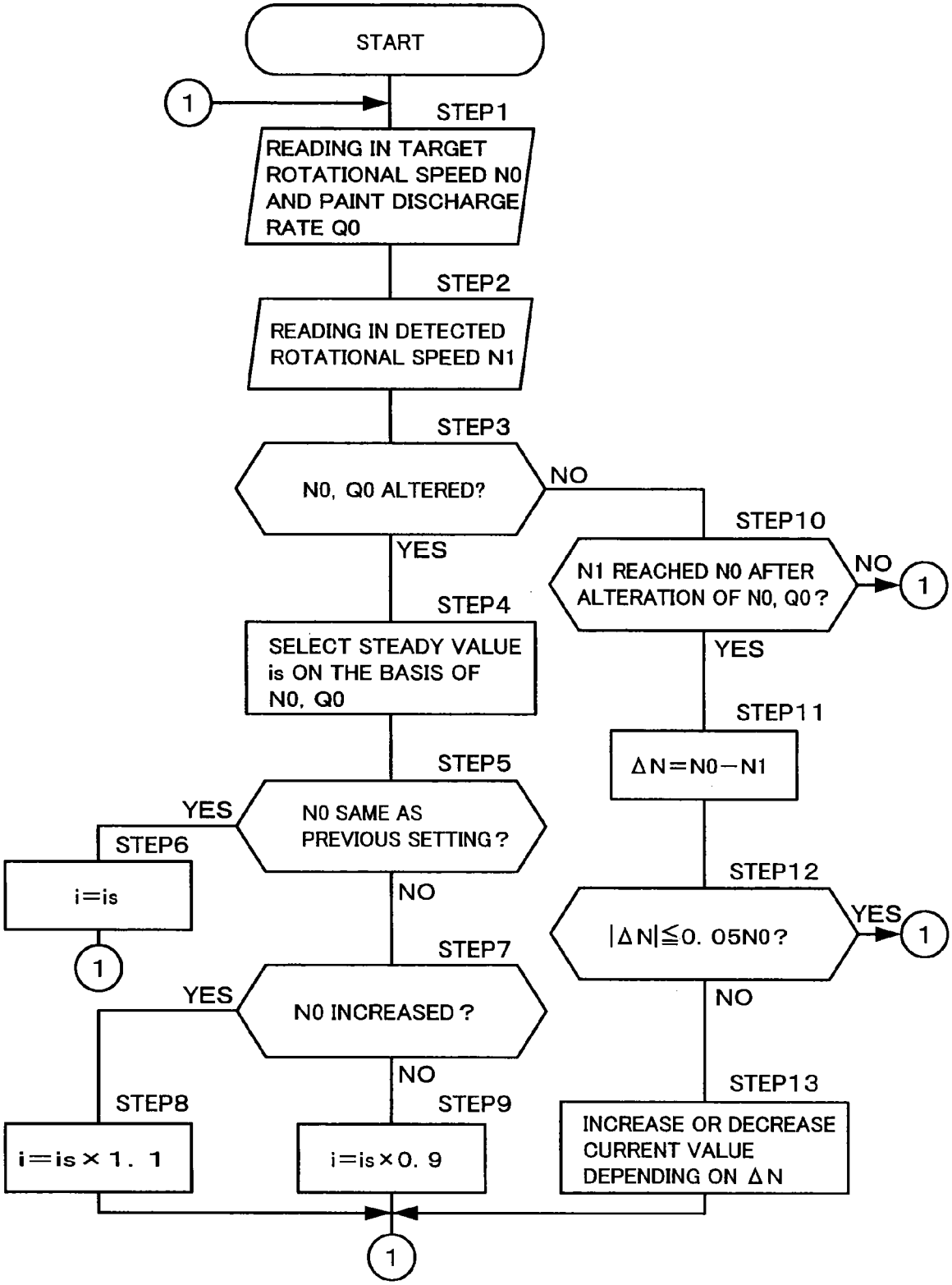
FIG. 4 is a flow chart of a rotational speed control processing of an air motor by a rotation controller shown in FIG. 1.

Indicated at 13 is a rotation controller which constitutes a controller together with a main control panel 16. According to rotational speed of the air motor 3, an air pressure to be supplied to the air motor 3 is controlled by the rotation controller 13, which is constituted by a control unit 14 and a D/A converter 15 which converts a digital output signal of the control unit 14 into an analog signal as an input current value i. The control unit 14 is provided with a memory 14A in which a rotational data selection processing table 17 of FIG. 3 and a rotational speed control processing program of FIG. 4 are stored.

Further, the control unit 14 is connected to the speed sensor 10 and main control panel 16, and also connected to the electropneumatic converter 12 through the D/A converter 15. According to the program stored in the memory 14A, a target rotational speed N0 set up by way of the main control panel 16 and a detected rotational speed N1 from the speed sensor 10 are compared by the rotation controller 13, increasing or decreasing the input current value i of the electropneumatic converter 12 to bring the motor speed into agreement with the target speed. Thus, the air pressure to be supplied to the air motor 3, that is to say, the rotational speed of the air motor 3 is controlled by way of feedback control of the rotation controller 13.

Further, according to the program of FIG. 4, in case a target rotational speed N0 after a speed change is higher than a target rotational speed N0 before the change, the rotation controller 13 outputs to the electropneumatic converter 12 an input current value i which will increase the air pressure, for example, by 10% as compared with a steady value is of the rotational data selection processing table 17 which will be described hereinafter. On the other hand, in case a target rotational speed N0 after a speed change is lower than a target rotational speed before the speed change, the rotation controller 13 outputs to the electropneumatic converter 12 an input current value i which will lower the air pressure, for example, by 10% as compared with a steady value is of the rotational data selection processing table 17.

In this instance, the target rotational speed N0 is increased or reduced by the main control panel 16 to spread or shrink a spray pattern, for example, in conformity with a shape of a work piece. On such an occasion, in relation with the increase or reduction of the target rotational speed N0, a paint discharge rate Q0 is increased or reduced by the main control panel 16. Further, paint on-off timings are preset in the main control panel 16 according to the shape of a work piece. Furthermore, at the time of restarting a coating operation (paint-on) after a suspension of paint supply (paint-off), the main control panel 16 has a function of setting a target rotational speed N0 at the same value as a target rotational speed N0 before the suspension.

Indicated at 17 is a rotational data selection processing table which is stored in the memory 14A of the control unit 14 as a steady value computing means. Stored in this rotational data selection processing table 17 are steady values i 00 to imn of the input current value i, which are determined by a target rotational speed N0 and a paint discharge rate Q0. The steady values i 00 to imn of the input current value i are values which are determined by actual measurements in relation with, for example, a target rotational speed N0 ranging from 5,000 rpm to 10,000 rpm and a paint discharge rate Q0 ranging from 100 cc/min to 1,000 cc/min as shown in FIG. 3, determining values at which the air motor 3 is rotationally driven in a stable state (steady state) within a deviation range of ±5% from a target rotational speed N0. Therefore, when the target rotational speed N0 becomes higher, a higher air pressure (an air pressure of a greater value) is set by the steady values i 00 to imn. Even if the target rotational speed N0 is of the same value, the air pressure is increased to a higher value (to a greater value) when the paint discharge rate Q0 is increased. When a target rotational speed N0 and a paint discharge rate Q0 are input, a steady value corresponding to the input target rotational speed N0 and paint discharge rate Q0 is selected (computed) and output by the rotational data selection processing table 17.

In operation, the rotational speed of the air motor 3 of the rotary atomizing head type coating machine of the present embodiment, with the above arrangements, is controlled by the rotation controller 13 in the manner as described below with reference to FIGS. 1 through 4.

In the first place, in Step 1 of FIG. 4, a target rotational speed N0 and a paint discharge (supply) rate Q0 are read in from the main control panel 16, and, in Step 2, a detected rotational speed N1 is read in from the motor speed sensor 10.

In the next place, in Step 3, the target rotational speed N0 and the paint discharge rate Q0 are checked out to see if there is a change from a previous setting. If judgement in Step 3 is "YES," it means that there has been a change in either the target rotational speed N0 or the paint discharge rate Q0, and the control goes to Step 4 to change the air pressure to be supplied to the air motor 3.

In Step 4, a steady value is, corresponding to the target rotational speed N0 and the paint discharge rate Q0, is selected from the steady values i 00 to imn of the rotational data selection processing table 17 memorized in the memory 14A in FIG. 3.

At this time, the values (steady values i 00 to imn) which are stored in the rotational data selection processing table 17 are actually measured values of the input current value i to the electropneumatic converter 12 in relation with settings of the target rotational speed N0 and the paint discharge rate Q0, in rotationally driving the air motor 3 within a deviation range of ±5% from a given target rotational speed N0. Therefore, in Step 4, a selection is made of a steady value is for rotationally driving the air motor 3 in a steady state after a change in the target rotational speed N0 or paint discharge rate Q0.

Next, in Step 5, the target rotational speed N0 after the changing of settings is checked out if it has been same as previous setting. If judgement in Step 5 is "YES," it means that no change has been made to the setting of the target rotational speed N0 (a change has been made only to the setting of the paint discharge rate Q0), and the control goes to next Step 6 to set a steady value is for the input current value i to be applied to the electropneumatic converter 12 and then returns to Step 1.

On the other hand, if judgement in Step 5 is "NO," the control goes to Step 7 to check out whether or not the target rotational speed N0 has been increased from a previous setting. If judgement in Step 7 is "YES," it means that the target rotational speed N0 has been increased after an alteration of settings and the rotational speed of the air motor 3 has to be increased as quickly as possible. For this purpose, in Step 8, in order to raise the air pressure above a steady state for increasing the rotational speed of the air motor 3 above a steady state, the input current value i to the electropneumatic converter 12 is set at a value which is greater than the steady value is (e.g., at a 10% greater value), repeating Step 1 and onwards thereafter.

On the other hand, if judgement in Step 7 is "NO," it means that the target rotational speed N0 has been reduced after an alteration of settings, and that the rotational speed of the air motor 3 has to be reduced as quickly as possible. Therefore, in order to lower the air pressure below a steady state for dropping the rotational speed of the air motor 3 below a steady state, the control goes to Step 9 to set the input current value i to the electropneumatic converter 12 at a value smaller than the steady value is (e.g., at a 10% smaller value), repeating Step 1 and onwards thereafter.

On the contrary, if judgement in Step 3 is "NO," it means that new settings of both of the target rotational speed N0 and the paint discharge rate Q0 are of the same values as compared with previously altered settings. Therefore, the control proceeds to Step 10 to check out if a detected rotational speed N1 has reached the target rotational speed N0 after a previous alteration of settings of the target rotational speed N0 and the paint discharge rate Q0. More particularly, after a judgement of "YES" in Step 3, a check is made in Step 10 as to whether or not a detected rotational speed N1 has ever reached a level which falls in a range of ±5% of the target rotational speed N0.

If judgement in Step 10 is "NO," it means that the machine operation is still in a transitional phase immediately after an alteration of settings of the target rotational speed N0 and the paint discharge rate Q0 and a detected rotational speed N1 has not yet reached the target rotational speed N0. Therefore, for the input current value i to the electropneumatic converter 12 (air pressure), a current setting (i.e, a value set up on the basis of a steady value is) is maintained, the control returning to and repeating Step 1 and onwards.

On the other hand, if judgement in Step 10 is "YES," it means that a transitional phase has lapsed and a detected rotational speed N1 has reached a target rotational speed N0. Therefore, the control proceed to Step 11 to calculate a differential in rotational speed ΔN between the target rotational speed N0 and the detected rotational speed N1. In Step 12, a check is made as to whether or not an absolute value of the differential in rotational speed ΔN is within a range of ±5% of the target rotational speed N0. If judgement in Step 12 is "YES," it means that a detected rotational speed N1 has already reached a value which is close to the target rotational speed N0. Therefore, in this case, maintaining a current setting for the input current value i to the electropneumatic converter 12 (air pressure), the control returns to and repeats the processing of Step 1 and onwards.

On the other hand, if judgement in Step 12 is "NO," it means that a detected rotational speed N1 differs from a target rotational speed N0. Therefore, the control proceeds to Step 13 to increase or decrease the input current value i of the electropneumatic converter 12 in such a way as to narrow the difference between the detected rotational speed N1 and the target rotational speed N0 on the basis of the differential in rotational speed ΔN, varying (raising or lowering) the air pressure to be supplied to the air motor 3. Thereafter, the control returns to and repeats the processing of Step 1 and onwards.

In a coating operation, the rotary atomizing head type coating machine, with the above-described arrangements according to the present embodiment, is operated in the manner as follows.

On the coater unit 1, the rotary atomizing head 4 is put in high speed rotation by the air motor 3, and in this state paint is supplied to the rotary atomizing head 4 through the feed tube 6. Paint is finely atomized and sprayed from the coater unit 1 by centrifugal force resulting from the high speed rotation of the rotary atomizing head 4. Sprayed paint is shaped into a controlled spray pattern by shaping air which is spurted forward from the shaping air ring 5, and deposited on a work piece.

In this instance, the target rotational speed N0 is increased or reduced by the main control panel 16, for example, for the purpose of enlarging or diminishing a spray pattern according to a shape of work piece. On such an occasion, if the target rotational speed N0 alone is changed, without changing the paint discharge rate Q0, the paint particle size becomes smaller when the air motor 3 is set at a higher rotational speed, while the paint particle sized becomes larger when the air motor 3 set at a lower rotational speed. That is to say, the paint particle size is varied depending on the target rotational speed N0. If the paint particle size is varied in this manner, the ultimate results will be degradation of finishing touches and quality of coatings. Therefore, at the time of increasing or decreasing the target rotational speed N0, the main control panel 16 increases or decreases the paint discharge rate Q0 as well. Further, paint on-off timings (paint supply start and stop timings) are preset in the main control panel 16.

In this regard, paired values of the target rotational speed N0 and the paint discharge rate Q0 are preset in the same timing. However, paint on-off timings are not necessarily preset in the same timing. When turning off paint supply, a target rotational speed N0 of a next paint-on timing is set up beforehand to lessen the extent of a drop in an actual rotational speed (or a real rotational speed) of the air motor 3 by the alternation of load which would occur upon changing settings. Further, timings of effectuating changed settings are determined in consideration of time lapses which are necessitated for coordinating relative positions of the coater unit 1 and coating surfaces of a work piece in transfer along a coating line.

At the time of increasing or decreasing the target rotational speed N0, the rotation controller 13 and air motor 3 operated in the manner as described below.

Firstly explained below is a case where the target rotational speed N0 is lowered as compared with a previous setting.

Figure 5:
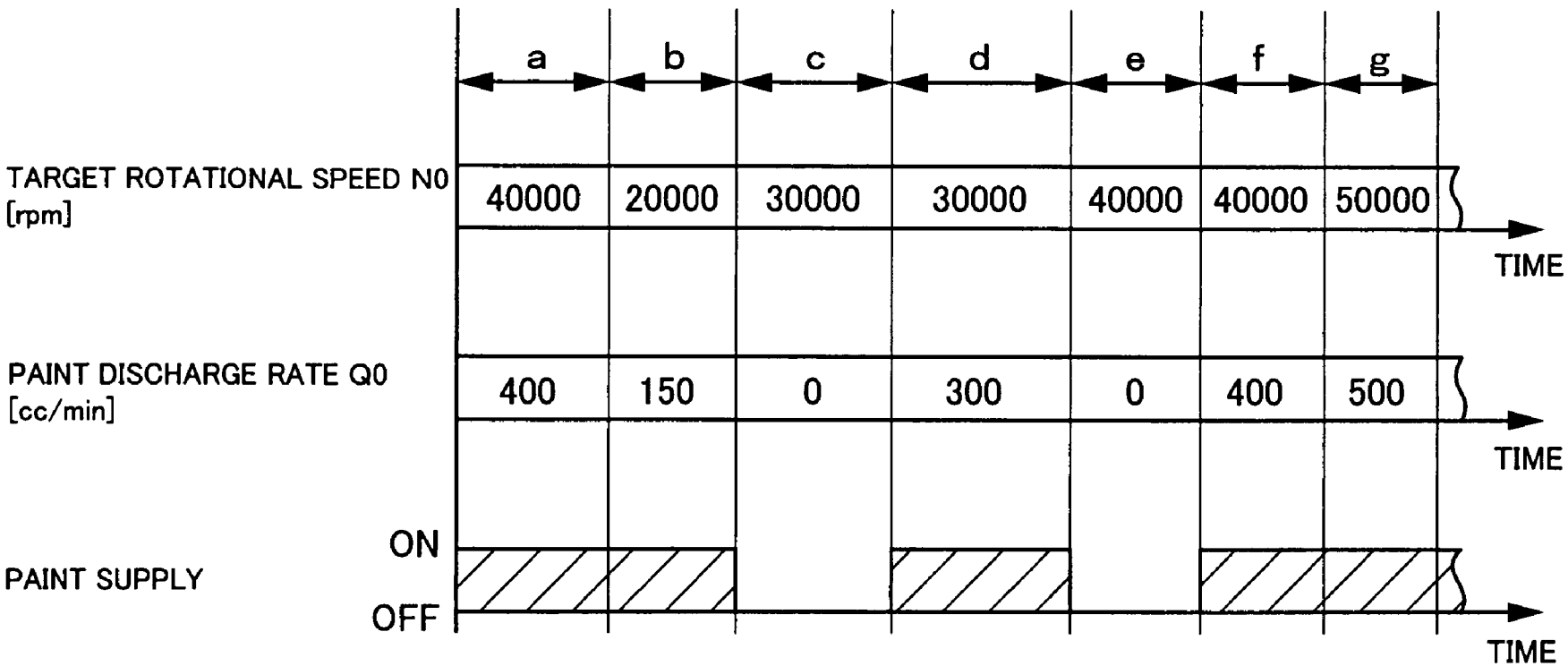
FIG. 5 is a time chart showing changes of settings in target rotational speed and paint discharge rate in relation with time.
Figure 6:
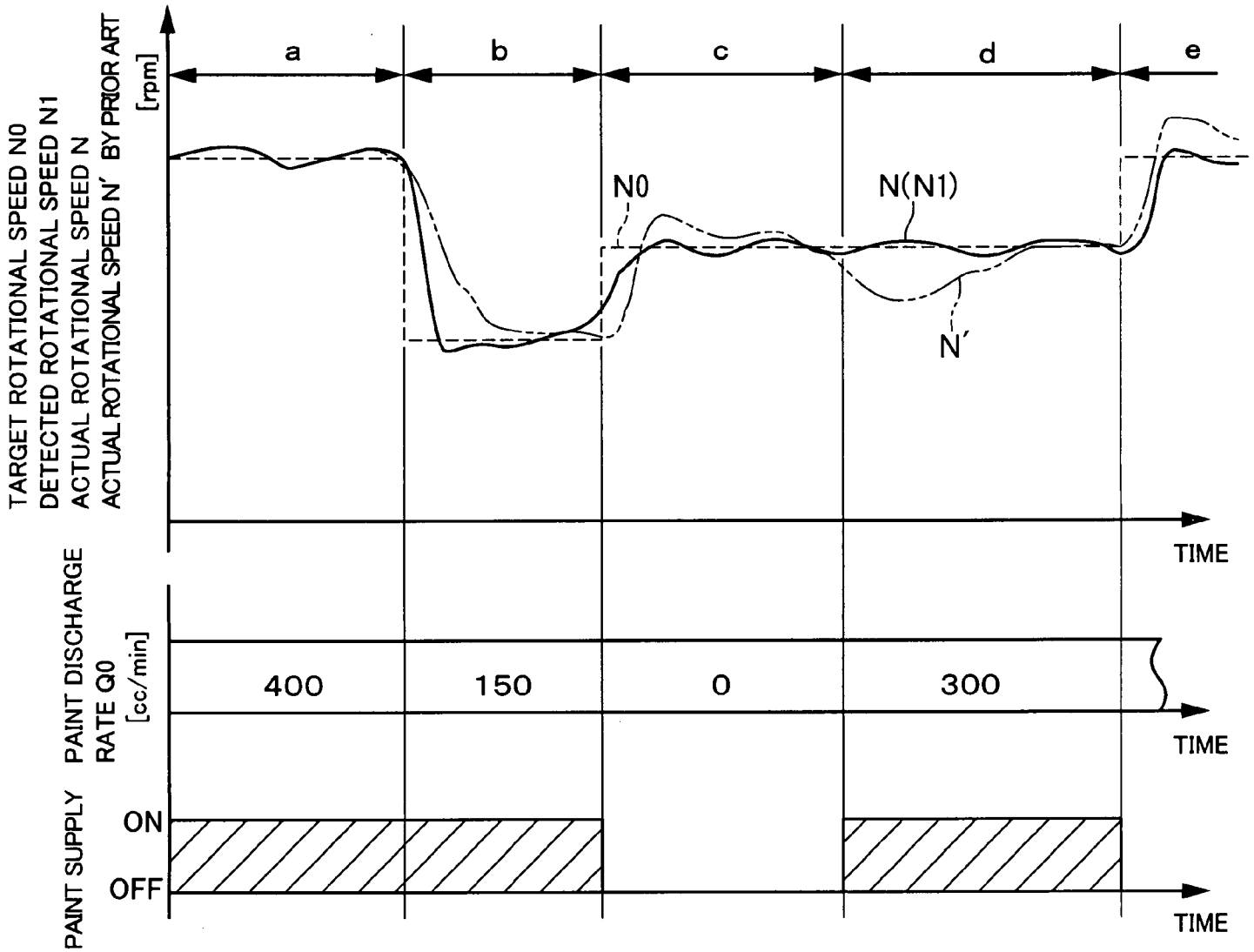
FIG. 6 is a characteristics diagram showing variations in target rotational speed and detected rotational speed in relation with time.

Let's take an example in which settings of the target rotational speed N0 and the paint discharge rate Q0 are to be changed from settings of operating conditions a to settings of operating conditions b shown in FIG. 5. More particularly, in this case, the target rotational speed N0 is lowered from 40,000 rpm to 20,000 rpm, and the paint discharge rate Q0 is lowered from 400 cc/min to 150 cc/min. Thus, in this case the target rotational speed N0 is changed to a lower setting (condition b) as compared with the previous setting (condition a). Therefore, the rotation controller 13 selects (computes) a steady value is from the rotational data selection processing table 17 shown in FIG. 4 on the basis of the target rotational speed N0 and the paint discharge rate Q0 of new setting, and outputs to the electropneumatic converter 12 the input current value i of a value which is, for example, 10% smaller than the steady value is. As a consequence, an air pressure corresponding to the input current value i is supplied from the air source 11 to the air motor 3, so that the actual rotational speed N (a detected rotational speed N1) of the air motor 3 quickly drops to the changed target rotational speed N0 as indicated by a solid line in FIG. 6. Further, since the air motor 3 is supplied with an air pressure close to a steady state, the rotational drive of the air motor 3 can be quickly brought near the target rotational speed N0 by feedback control.

Now, described below is a case where the target rotational speed N0 of new setting is increased as compared with a previous setting.

Here, let's take an example where settings of the target rotational speed N0 and the paint discharge rate Q0 are to be changed from operating conditions b to operating conditions c of FIG. 5. More particularly, in this case, the target rotational speed N0 is increased from 20,000 rpm to 30,000 rpm, while the paint discharge rate Q0 is dropped from 150 cc/min to 0 cc/min.

In this instance, during the period of operating conditions c, paint supply is suspended, that is to say, paint supply is turned off. Therefore, during the period of operating conditions c, the target rotational speed N0 is preset at a value corresponding to a target rotational speed N0 to be set in time with a next paint-on timing (a time point of restarting paint supply), that is to say, at a value of the target rotational speed N0 of operating conditions d (e.g., 30,000 rpm) which come after the operating conditions c.

In this case, the target rotational speed N0 of new setting is set at a higher value in the operating conditions c than the previous setting (in the previous operating conditions b). Therefore, the rotation controller 13 selects a steady value is from the rotational data selection processing table 17 of FIG. 4 on the basis of next target rotational speed N0 and paint discharge rate Q0, and output to the electropneumatic converter 12 an input current value i which is larger, for example, 10% than the selected steady value is. Whereupon, an air pressure corresponding to the input current value i is supplied from the air source 11 to the air motor 3, so that the actual rotational speed N of the air motor 3 is promptly increased to reach the target rotational speed N0 of new setting as indicated by a solid line in FIG. 6. Further, since the air motor 3 is supplied with an air pressure which is close to a steady state pressure, thereafter the air motor 3 can be quickly driven in the vicinity of the target rotational speed N0 by feedback control.

In contrast, as a Comparative Example, the rotational drive of the air motor 3 was controlled only by way of using difference of rotational speed ΔN between a target rotational speed N0 and a detected rotational speed N1 like a prior art controller. Time variability of actual rotational speed N' of the air motor 3 is indicated by a two-dot chain line in the chart of FIG. 6.

In the case of the Comparative Example, for example, when the target rotational speed N0 is decreased (e.g., by alteration of operating conditions from a to b), the actual rotational speed N' of the air motor 3 cannot follow up the change promptly, and there is a delay in dropping the actual rotational speed N' to the level of the target rotational speed N0. Further, for example, when the target rotational speed N0 is increased (e.g., by alteration from operating conditions b to c), there are possibilities of the actual rotational speed N' of the air motor 3 being increased largely in excess of the target rotational speed N0.

Moreover, even in a case where the target rotational speed N0 is not changed, fluctuations in the actual rotational speed N' of the air motor 3 against the target rotational speed N0 are experienced with the prior art as the load of the rotary atomizing head 4 varies when the paint discharge rate Q0 is changed (e.g., by alternation from operating conditions c to d). Therefore, it takes time until the actual rotational speed N' of the air motor 3 settles at the target rotational speed N0, despite a problematic trend that paint is atomized into different undesired particle sizes to degrade the quality of coatings.

However, according to the present embodiment of the invention, the rotation controller 13 is provided with the rotational data selection processing table 17 for computing a steady value is of an input current value i to be input to the electropneumatic converter 12, on the basis of settings of a target rotational speed N0 and a paint discharge rate Q0. And the rotation controller 13 is computing a steady value is from the rotational data selection processing table 17 on the basis of the new setting of the target rotational speed N0 and the paint discharge rate Q0 whenever either the target rotational speed N0 or the paint discharge rate Q0 is changed, and outputting to the electropneumatic converter 12 the input current value i on the basis of the freshly computed the steady value is. Thus, according to the present embodiment, even if setting of either the target rotational speed N0 or the paint discharge rate Q0 is changed, the air motor 3 can be driven quickly in the vicinity of the target rotational speed N0 in a steady state. Accordingly, even when settings of the target rotational speed N0 and the paint discharge rate Q0 are altered, paint can be atomized and sprayed toward a work piece continuously in a desired particle size to guarantee high quality of coatings.

Furthermore, when a target rotational speed N0 is set at a higher speed by alteration of settings, the rotation controller 13 outputs to the electropneumatic converter 12 an input current value i of an air pressure higher than that of the steady value is, to increase the target rotational speed N0 of the air motor 3 to a level higher than a new target rotational speed N0. On the other hand, when a target rotational speed N0 is set at a lower speed by alteration of settings, the rotation controller 13 outputs to the electropneumatic converter 12 an input current value i of an air pressure lower than that of a steady value is, to decrease the rotational speed of the air motor 3 below a new target rotational speed N0. Therefore, according to the fluctuation of the rotational speed of the air motor 3, the rotation controller 13 increase and decrease the air pressure to the air motor 3 compare with steady condition. As a consequence, according to the present embodiment, while preventing increasing or decreasing the rotational speed of the air motor 3 beyond a target rotational speed N0 by an overshoot, the air motor 3 can be quickly brought to the level of a target rotational speed N0. That is to say, at the time of changing operating conditions of a coating operation, it becomes possible to reduce (shorten) the time lag for bringing an air motor 3 to the level of the target rotational speed N0 from a deviated speed level.

Further, after a detected rotational speed N1 reaches the target rotational speed N0, the rotation controller 13 goes to feedback control based on a rotational speed differential ΔN. More particularly, immediately after alteration of setting of the target rotational speed N0, the rotation controller 13 outputs to the electropneumatic converter 12 an input current value i which is increased or reduced relative to a steady value is to bring the rotational speed of the air motor 3 quickly to the level of the target rotational speed N0. As soon as the rotational speed of the air motor 3 is reached to the target rotational speed N0, the rotation controller 13 goes to feedback control based on a rotational speed differential ΔN to maintain the rotational speed of the air motor 3 in the vicinity of the target rotational speed N0.

Further, at the time of turning off or suspending paint supply (paint-off), the rotation controller 13 sets up a target rotational speed N0 of the same value as a target rotational speed N0 at the time of reopening paint supply (paint-on) after that. As a consequence, during a paint-off period, the rotation controller 13 can drive the air motor 3 at a speed which will be required on restarting paint supply in a next stage of operation, thereby to reduce fluctuations in rotational speed at the time of restarting paint supply and at the same time reducing time lags which occur at the time of altering settings in operating conditions.

Figure 7:
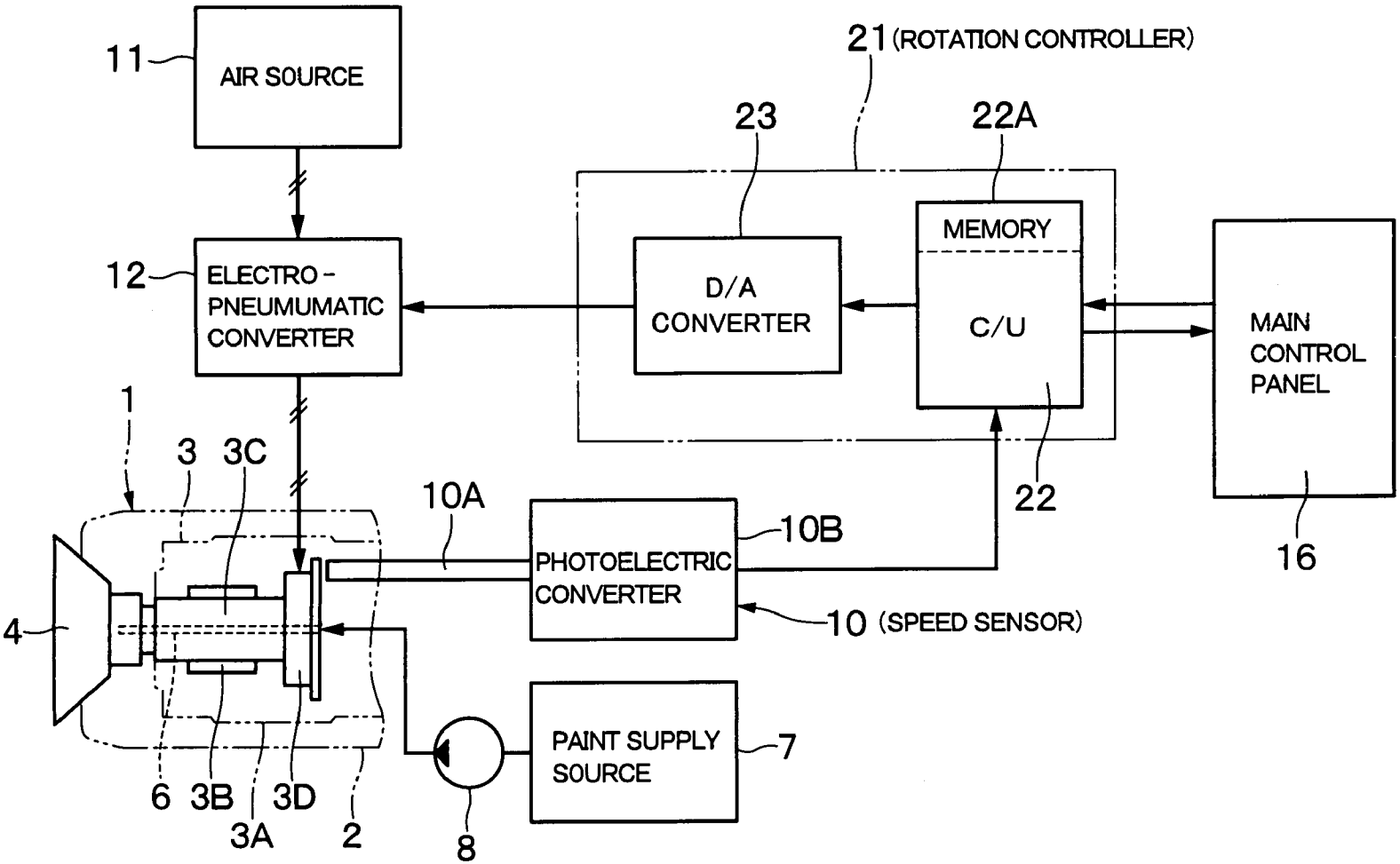
FIG. 7 is a diagrammatic illustration of a rotary atomizing head type coating machine according to a second embodiment of the invention, showing general arrangements of the machine.

Now, turning to FIGS. 7 to 9, there is shown a second embodiment of the present invention. A feature of this embodiment resides in that a steady value of input current value of electropneumatic converter is computed from a rotation data selection processing table on the basis of factors in coefficient of viscosity and specific gravity of paint in addition to target rotational speed and paint discharge rate. In the following description of the second embodiment, those component parts which are identical with counterparts in the foregoing first embodiment are simply designated by the same reference numerals or characters to avoid repetitions of same explanations.

Indicated at 21 is a rotation controller adopted in the second embodiment to constitute a controller along with the main control panel 16. Similarly to the rotation controller 13 in the first embodiment, the rotation controller 21 is constituted by a control unit 22, and a D/A converter 23 for converting digital output signals of the control unit 22 into an analog input current value i. Further, the control unit 22 is connected to the main control panel 16, and provided with a memory 22A. A rotational speed control processing program similar to the one in the first embodiment is stored in the memory 22A along with rotation data selection processing tables 24 and 25 of FIGS. 8 and 9.

Indicated at 24 and 25 are rotational data selection processing tables which are stored in the memory 22A of the control unit 22 as steady value computation means. The rotational data processing tables 24 and 25 are arranged almost in the same manner as the rotational data processing table 17 in the foregoing first embodiment. Namely, the rotational data processing tables 24 and 25 contain steady values i 000 to i 0mn and steady values i 100 to i 1mn of the input current value i, respectively, which are determined on the basis of a target rotational speed N0 and a paint discharge rate Q0. In this instance, the steady values i 000 to i 0mn and i 100 to i 1mn are actually measured values of the input current value i to the electropneumatic converter 12 in rotationally driving and maintaining the air motor 3 (in a steady state) within a range of ±5% of a target rotational speed N0, with a setting of the target rotational speed N0, for example, from 5,000 rpm to 100,000 rpm and a setting of the paint discharge rate Q0 from 100 cc/min to 1,000 cc/min.

However, the rotational data selection processing tables 24 and 25 differ from the rotational data selection processing table 17 of the first embodiment, for example, in that these tables 24 and 25 consider a coefficient of viscosity η0, η1 (a coefficient corresponding to viscosity) and specific gravity κ0, κ1 of the paint, respectively. More particularly, the rotational data selection processing table 24 contains, for example, steady values i 000 to i 0mn for a color A paint having a coefficient of viscosity η0 and a specific gravity κ0. On the other hand, the rotational data selection processing table 25 contains, for example, steady values i 100 to i 1mn for a color B paint having a coefficient of viscosity η1 and a specific gravity K1.

Thus, in computing a steady value is of an input current value i to be applied to the electropneumatic converter 12 on alteration of a setting in coating conditions, the rotation controller 21 of the present embodiment takes into consideration a coefficient of viscosity η0, η1 and specific gravity κ0, κ1, in addition to the target rotational speed N0 and the paint discharge rate Q0. Thus, even when the load on the rotary atomizing head 4 is fluctuated due to variations in coefficient of viscosity and specific gravity of the paint, optimum steady values is can be selected from the rotational data selection processing tables 24 and 24.

Being arranged in the manner as described above, the second embodiment can produce substantially the same operational effects as the forgoing first embodiment. Especially in the case of the second embodiment, the rotational data selection processing tables 24, 25 include the factors in coefficient of viscosity η0, η1 and specific gravity κ0, κ1 of the paint in addition to the target rotational speed N0 and the paint discharge rate Q0 for computation of a steady value is of the input current value i. Therefore, according to the present embodiment, the air motor 3 can be rotationally driven in a steady state even under the circumstances where a load on the rotary atomizing head 4 is varied by variations in such factors as coefficient of viscosity $\eta 0$, $\eta 1$ and specific gravity $\kappa 0$, $\kappa 1$ of the paint.

Further, in the second embodiment, two rotational data selection processing table 24 and 25 are provided to permit computation of steady values is of two different paint colors (color A and color B) on the basis of coefficient of viscosity $\eta 0$, $\eta 1$ and specific gravity $\kappa 0$, $\kappa 1$. Of course, there may be provided rotational data selection processing tables which are arranged to permit selection of a steady value from three or more measures in coefficient of viscosity and specific gravity. Since values of coefficient of viscosity and specific gravity can change depending upon the concentration of a solvent even in the case of a paint is of the same color, it becomes possible to select an optimum steady value on the basis of readings in coefficient of viscosity and specific gravity which are constantly checked out.

Figure 10:
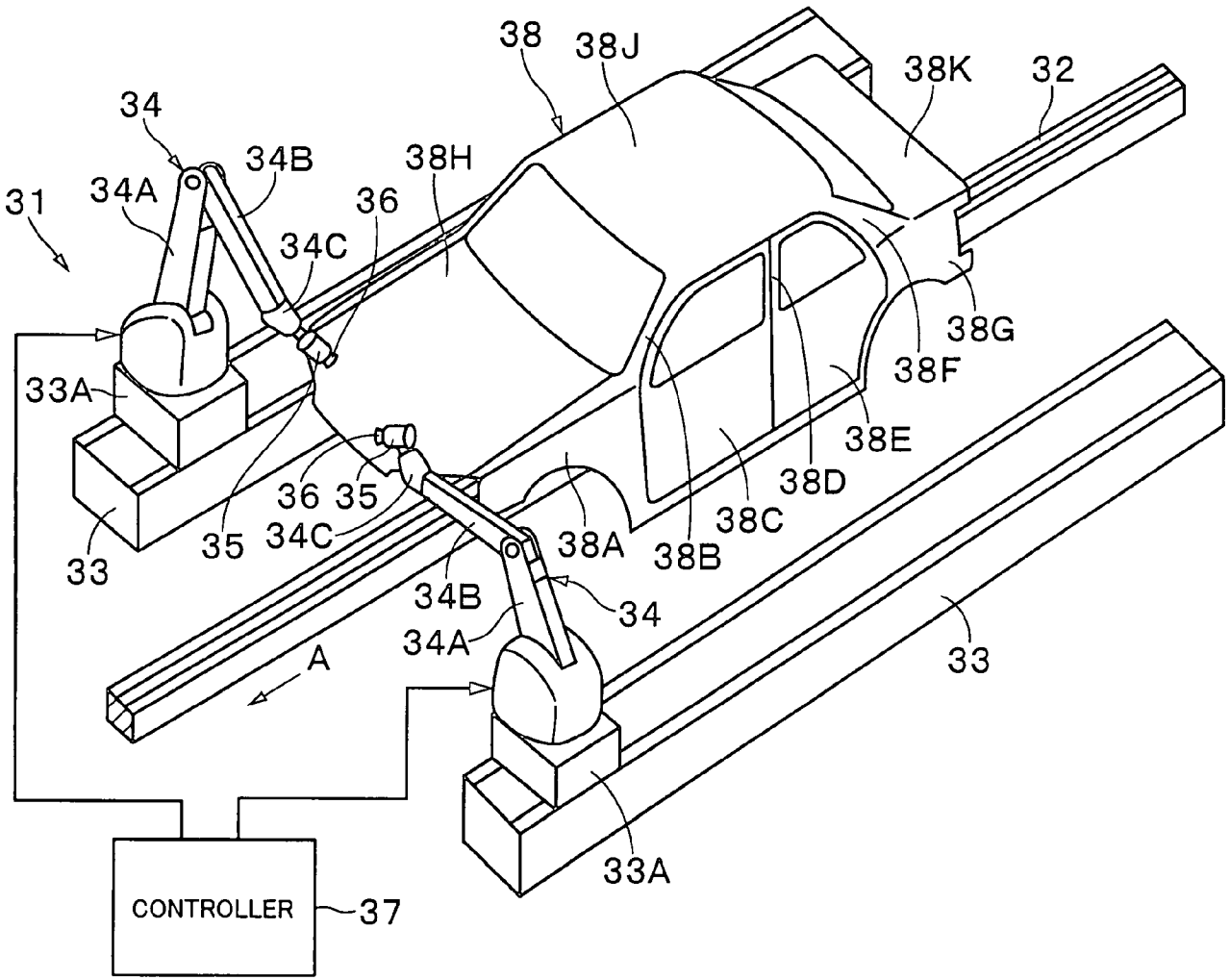
FIG. 10 is a schematic perspective view of a rotary atomizing head type coating machine according to a third embodiment of the invention.
Figure 11:
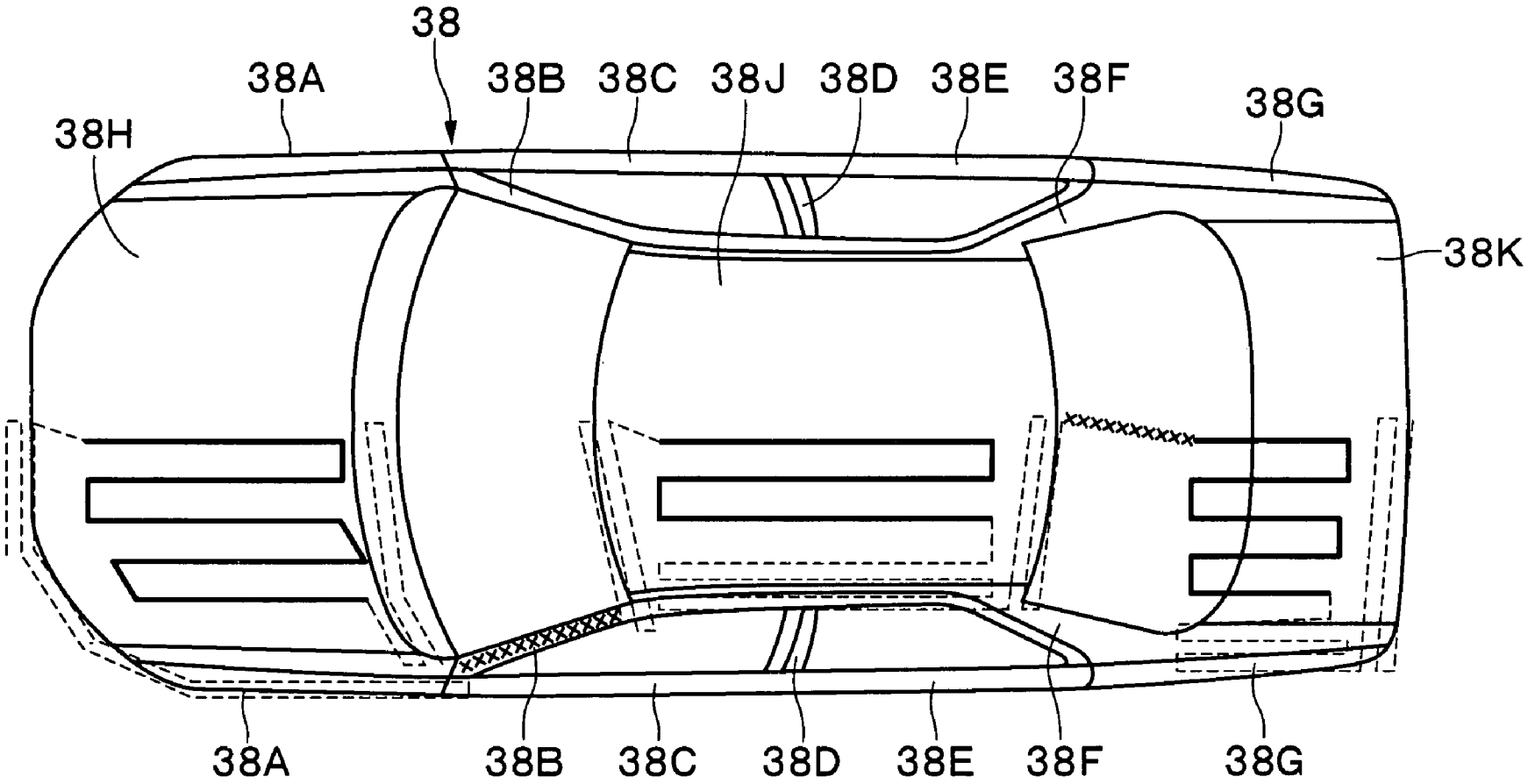
FIG. 11 is a plan view of a vehicle body, showing loci of movements of a coater unit at the task of coating a left half of the top side of the vehicle body.

Now, turning to FIGS. 10 and 11, there is shown a third embodiment of the present invention. A feature of this embodiment resides in that the paint discharge rate (paint feed rate) as well as the rotational speed of the air motor is increased at the time of coating a broad surface area, and the paint discharge rate as well as the rotational speed is decreased at the time of paint a narrow surface area. In the following description of the third embodiment, those component parts which are identical with counterparts in the foregoing first embodiment are simply designated by the same reference numerals or characters to avoid repetitions of same explanations.

In FIG. 10, indicated at 31 is a rotary atomizing head type coating machine which is mounted on a floor of a coating booth, which is largely constituted by a conveyer 32, a coating robot 34 and a coater unit 35 which will be described hereinafter.

Indicated at 32 is a conveyer which is provided on the floor of the coating booth to transfer an automotive vehicle body 38 on a support table (not shown) in the direction of arrow A at a predetermined speed.

Denoted at 33 are right and left tracking apparatus which are provided along and on the opposite sides of the conveyer 32. Each tracking apparatus 33 is provided with a tracker table 33A which is movable in parallel relation with the conveyer 32 to move a coater unit 35, which will be described hereinafter, in step with a vehicle body 38 on the conveyer 32.

Denoted at 34 are coating robots which are mounted on the tracker table 33A of the right and left tracking apparatus 33. Each one of the coating robots 34 is largely constituted by a vertical arm 34A which is rotatably and pivotally mounted on the tracker table 33A, a horizontal arm 34B which is pivotally connected to the upper end of the vertical arm 34A, and a wrist portion 34C which is attached to the fore end of the horizontal arm 34B.

Indicated at 35 are right and left coater units which are attached to wrist portions 34C of the coating robots 34. Similarly to the coater unit 1 in the first embodiment, each one of the coater units 35 is provided with a rotary atomizing head 36 to be put in high speed rotation at the fore end of the coater unit 35, and connected to a controller 37 including a rotation controller.

Depending upon the shape of a vehicle body 38 which will be described hereinafter, the controller 37 increases the paint discharge rate Q0 as well as the target rotational speed N0 when coating a broad surface area, for example, on a center portion of a bonnet 38H, and decreases the paint discharge rate Q0 as well as the target rotational speed N0 when coating a narrow surface area on a pillar 38B or the like. By controlling the paint discharge rate Q0 and the target rotational speed N0 in this manner by the controller 37, the size of the paint spray pattern is switched between a small spray pattern and a large spray pattern. Further, the controller 37 is provided with a rotational data selection processing table (not shown) similar to the rotational data selection processing table 17 in the first embodiment, to output to an electropneumatic converter an input current value i based on a selected steady value is in the same manner as in the first embodiment whenever either the target rotational speed N0 or the paint discharge rate Q0 is changed.

Denoted at 38 is a body of an automotive vehicle as a work piece, which is placed and transferred on the support table of the conveyer 32. As shown in FIG. 11, the automotive vehicle body 38 is largely constituted by right and left front fenders 38A, right and left front pillars 38B, right and left front doors 38C, right and left center pillars 38D, right and left rear doors 38E, right and left rear pillars 38F, right and left rear fenders 38G, bonnet 38H, roof 38J, and trunk lid 38K.

Described below is a method for coating upper or top surface portions of the automotive vehicle body 38 with reference to FIGS. 10 and 11.

More particularly, left half sections of upper surfaces of the automotive vehicle body 38, including left half sections of the bonnet 38H, roof 38J, trunk lid 38K, are coated in the manner as described below with reference to FIG. 11.

Shown in FIG. 11 are loci of general movements taken by the coater unit 35 in coating left half sections of upper surfaces of the vehicle body 38. Namely, in FIG. 11, fine broken lines, thick solid lines and cross marks shown on the coating left half sections of upper surfaces of the vehicle body 38 indicate different spray patterns of the coater unit 35 along loci of its movements.

In this instance, fine broken lines on left half sections of upper surfaces of the vehicle body 38 indicate a locus of the coater unit 35 operating with a small spray pattern, and fine broken lines are drawn in the vicinity of marginal edge portions of the bonnet 38H, roof 38J and trunk lid 38K. On the other hand, thick solid lines are drawn on center portions of the bonnet 38H, roof 38J and trunk lid 38K.

At the time of coating marginal edge portions of left half sections of the bonnet 38H, roof 38J and trunk lid 38K, the target rotational speed N0 as well as the paint discharge rate Q0 of the coater unit 35 is decreased to coat paint in a small spray pattern along the fine broken lines.

Further, at the time of coating center portions of left half sections of the bonnet 38H, roof 38J and trunk lid 38K, the target rotational speed N0 as well as the paint discharge rate Q0 of the coater unit 35 is increased to coat paint in a large spray pattern along the thick solid lines.

Right half sections of upper surface of the vehicle body 38 are coated in the same manner as the above-described left half sections except that they are symmetrically on the opposite side from the left half sections. Therefore, description on the method of coating right half sections of the vehicle body 38 is omitted here. Further, when coating right or left lateral side portions of the vehicle body 38, the target rotational speed N0 as well as the paint discharge rate Q0 is increased to enlarge the spray pattern, for example, on the door 38C or 38E which has a broad coating surface area. On the other hand, when coating the pillars 38B, 38D and 38F which have a narrow coating surface area, the target rotational speed N0 as well as the paint discharge rate Q0 is decreased to coat paint in a small spray pattern.

Being arranged in the manner as described above, the third embodiment of the invention can produce substantially the same operational effects as the foregoing first embodiment.

Especially, according to the present embodiment, the controller 37 is adapted to increase the paint discharge rate Q0 and the target rotational speed N0 as well at the time of coating a broad surface area, and to decrease the paint discharge rate Q0 and the target rotational speed N0 as well at the time of coating a narrow surface area. Accordingly, a broad surface area of a work piece is coated with a large spray pattern by increasing the rotational speed of the rotary atomizing head 36. On the other hand, a narrow surface area of a work piece is coated with a small spray pattern by decreasing the rotational speed of the rotary atomizing head 36. Therefore, at the time of coating an automotive vehicle body 38 with coating surface areas of complicate shapes, the spray pattern size can be enlarged or diminished according to the shapes of coating surfaces of the vehicle body 38, permitting to form coatings of high quality with less paint consumption, cutting the amount of paint which is wastefully discarded by overspraying.

On enlarging or diminishing a spray pattern size according to the size of the surface area, the target rotational speed N0 as well as the paint discharge rate Q0 is increased or decreased, so that, irrespective of the enlargement or diminution of the spray pattern size, almost the same paint particle size can be maintained throughout a coating operation, maintaining constantly a high level of finish and enhancing the quality of coatings.

In the third embodiment, steady values is are computed on the basis of the target rotational speed N0 and the paint discharge rate Q0 by the use of a rotational data selection processing table in the same manner as in the foregoing first embodiment. However, the rotational data selection processing table may be arranged to include such factors as coefficient of viscosity and specific gravity of paint in addition to the target rotational speed N0 and the paint discharge rate Q0 for computation of the steady values is in the same manner as in the foregoing second embodiment.

In each one of the foregoing embodiments, the rotary atomizing head type coating machine of the invention is described as a directly charging type on which paint is charged with a high voltage directly through the rotary atomizing head 4. However, the present invention can also be applied to an indirectly charging rotary atomizing head coating machine which is adapted to charge sprayed paint particles with a high voltage indirectly by way of external electrodes which are provided on the outer peripheral side of the cover of the rotary atomizing head coating machine.

The invention claimed is:

1. A rotary atomizing head type coating machine, comprising:

a rotary atomizing head to spray supplied paint, an air motor coupled with said rotary atomizing head and rotated by a supply of air, a speed sensor to detect rotational speed of said air motor, an air source to supply an air to said air motor, an electropneumatic converter to adjust an air pressure supplied from said air source according to an electrical quantity, and a controller configured to control an electrical quantity to be output to said electropneumatic converter to diminish a differential between said rotational speed detected by said speed sensor and a given target rotational speed to provide a feedback control of said air pressure, wherein said controller is provided with a steady value computing device configured to compute a necessary value of electrical quantity as a steady value against given settings in arbitrary target rotational speed and paint discharge rate to drive said air motor steadily in a vicinity of said given target rotational speed and at said paint discharge rate;

when either said target rotational speed or said paint discharge rate is to be changed, said controller is configured to compute a new steady value on a basis of a changed target rotational speed and paint discharge rate by a use of said steady value computing device, and to output to said electropneumatic converter an electrical quantity on a basis of said changed target rotational speed and paint discharge rate by use of said steady value computing device;

said controller further being adapted to output to said electropneumatic converter an electrical quantity for an air pressure higher than that of said new steady value when said target rotational speed is to be changed to a higher speed, to rotate said air motor at a speed higher than a newly set target rotational speed, and an electrical quantity for an air pressure lower than that of said new steady value when said target rotational speed is to be changed to a lower speed, to rotate said air motor at a speed lower than a newly set target rotational speed.

2. The rotary atomizing head type coating machine as defined in claim 1, wherein said steady value computation device is configured to compute a steady value of said electrical quantity on a basis of a coefficient of viscosity and a specific gravity of paint in addition to said target rotational speed and paint discharge rate.

3. The rotary atomizing head type coating machine as defined in claim 1, wherein said controller configured to go to feedback control on a basis of said differential in rotational speed, after said detected rotational speed has reached said target rotational speed.

4. The rotary atomizing head type coating machine as defined in claim 1, wherein at the time of suspending paint supply, said controller is configured to preset a target rotational speed at the same value as a target rotational speed to be set upon restarting paint supply.

5. The rotary atomizing head type coating machine as defined in claim 1, wherein said controller is configured to increase said paint discharge rate as well as said target rotational speed at a time of coating a broad surface area of a work piece, and to decrease said paint discharge rate as well as said target rotational speed at a time of coating a narrow surface area of a work piece.

* * * * *